United States Patent [19]

Kawakubo et al.

[11] Patent Number: 4,600,397

[45] Date of Patent: Jul. 15, 1986

[54] METHOD OF PRODUCING DISCHARGE DISPLAY DEVICE

[75] Inventors: Osamu Kawakubo, Saitama; Eiji Munemoto; Akihiko Okubora, both of Kanagawa, all of Japan

[73] Assignee: Sony Corporation, Tokyo, Japan

[21] Appl. No.: 721,956

[22] Filed: Apr. 11, 1985

[30] Foreign Application Priority Data

Apr. 19, 1984 [JP] Japan ..... 59-79218

[51] Int. Cl.[4] ..... H01J 9/12

[52] U.S. Cl. ..... 445/6; 445/24; 445/50; 427/77; 427/126.2; 313/355; 313/630

[58] Field of Search ..... 445/24, 25, 50–51, 445/6; 313/346 R, 355, 630; 427/77, 126.2

[56] References Cited

U.S. PATENT DOCUMENTS 2,172,207 9/1939 Kolligs et al. ..... 427/77 X
4,126,809 11/1978 Wedding et al. ..... 313/587
4,317,750 3/1982 Provance et al. ..... 427/126.2
4,393,326 7/1983 Kamegaya et al. ..... 445/24 X
4,429,250 1/1984 Clere et al. ..... 313/346 R
4,554,482 11/1985 Kamegaya et al. ..... 313/630 X

*Primary Examiner*—Kenneth J. Ramsey
*Attorney, Agent, or Firm*—Hill, Van Santen, Steadman & Simpson

[57] ABSTRACT

The present invention discloses a method of producing a discharge display device which enables formation of a satisfactory $LaB_6$ cathode without using a $LaB_6$ paste containing a glass binder. The method of the present invention comprises the steps of applying a conductive paste containing a glass binder, temporarily drying said conductive paste to form a conductive paste layer, forming a $LaB_6$ layer containing no glass binder on said conductive paste layer, burning said conductive paste layer and said $LaB_6$ layer, at the same time, and activating said $LaB_6$ layer after being burnt, and after an exhausting step by gas discharge with large current to form a $LaB_6$ cathode.

3 Claims, 5 Drawing Figures

METHOD OF PRODUCING DISCHARGE DISPLAY DEVICE

BACKGROUND OF THE INVENTION

1. Field of the Invention

This invention relates to a method of producing a discharge display device and more particularly to a method of forming a $LaB_6$ cathode for the discharge display device.

2. Description of the Prior Art

Recently, development of discharge display devices, especially direct current type XY matrix discharge display panels termed plasma display panels, or PDP, has been promoted. Fundamental problems in this development are both of improvement in discharge efficiency, that is, achievement of high luminance with low power consumption, and increasing life of the discharge display panel by stabilizing electrodes and the other materials as regards their physical and chemical properties. Research in the area of electrode (especially, cathode) materials and structures is important to the solution of the problems.

Nickel (Ni) is conventionally used as an anode and a cathode. Ni has little resistance against discharge sputtering, and therefore a Ni cathode deteriorates in several seconds of operation. To cope with this, in prior art arrangements, mercury (Hg) has been sealed in the discharge display panel and deposited on a surface of the electrode to suppress sputtering. However, when mercury (Hg) is sealed in the discharge display panel, it is difficult to maintain discharge characteristics of each display cell uniform over a long time in the discharge display panel with a large capacity, as non-distribution of the mercury occurs due to change on standing.

Further, when such a discharge display panel is used in a closed room such as a cockpit, mercury cannot be used due to health hazards.

Meanwhile, lanthanum boride ($LaB_6$) had been proposed as a cathode material. $LaB_6$ has advantages that its work function is low ($\gamma$ coefficient is large) and discharge efficiency is high; and it is superior in physical and chemical stability due to its covalent bonding structure.

However, a $LaB_6$ cathode has not yet reached practical use for the reason that its usual production process employing a thin-film evaporation method or a plasma spraying method, is complicated and results in increase in cost. Particularly, it is difficult to form a relatively uniform electrode with a large capacity and a large screen. Another reason is that the electrode cannot be formed in connection with the other panel structure by a thick-film printing method with a low cost.

In the case where a $LaB_6$ cathode is intended to be formed by the thick-film printing method, it is generally burnt in the atmosphere of nitrogen $N_2$ at 800°–900° C. after printing and application. However, as the substrate of the discharge display panel is glass, the temperature is permitted to be raised up to about 600° C., and as the structure such as the other electrodes and barrier is oxide, such a burning step is usually carried out in air. For these reasons, it is difficult to form the $LaB_6$ cathode. In addition, $LaB_6$ has a high melting point of about 2300° C., and therefore it cannot be sintered at a temperature of about 600° C. with the result that resistance after formation of the cathode is disadvantageously increased to $10^9\ \Omega$ and more. In case that the thick-film printing method is adopted, a binder substance such as frit glass is generally mixed with $LaB_6$ powder so as to obtain a bonding strength between each of the $LaB_6$ powder particles. However, it is considered impractical to use glass binder mixed with $LaB_6$ powder since it causes high resistance after formation of the $LaB_6$ cathode.

On the other hand, the present inventors have developed a method of forming a $LaB_6$ cathode which enables the $LaB_6$ cathode to be formed by a thick-film printing method. See copending related application Ser. No. 721,955, filed concurrently. According to that method, a $LaB_6$ paste is prepared by using an ionic conductive alkali glass as a glass binder, and the $LaB_6$ paste is applied and printed onto a base electrode such as Ni, thereafter burning the same in the air at 500°–600° C. Then, after such steps as frit sealing, heating exhaustion, gas sealing and final sealing of the discharge display panel, voltage is applied between an anode and a cathode to effect activation treatment by gas discharge with large current. With this activation treatment, no glass becomes present on the $LaB_6$ layer, and $LaB_6$ is exposed to the surface of the $LaB_6$ layer. Simultaneously, a surface of each $LaB_6$ particle is fused and bound with other particles, thus forming the $LaB_6$ cathode.

However, it is preferred that glass binder not be contained in the $LaB_6$ paste. This is due to the fact that as the surface of the $LaB_6$ particles and the space therebetween is covered or filled with glass binder, it is difficult to form an electrical conductive path, resulting in difficulty in activation of the electrodes, and that in case of using a frit glass containing lead (Pb) as the binder, there is a possibility that the life endurance characteristic will be reduced by sputtering of metallic Pb as deposited.

SUMMARY OF THE INVENTION

Accordingly, it is an object of the present invention to provide a method of producing a discharge display device which enables formation of a satisfactory $LaB_6$ cathode without using a $LaB_6$ paste containing a glass binder.

According to the present invention, there is provided a method of producing a discharge display device comprising the steps of applying a conductive paste containing a glass binder, temporarily drying the conductive paste, applying and printing a $LaB_6$ paste onto the conductive paste layer or electrodepositing $LaB_6$ containing no glass binder to form a $LaB_6$ layer, burning the conductive paste layer and the $LaB_6$ layer at the same time, and activating the $LaB_6$ layer after burnt by gas discharge with large current after an exhaustion step to form a $LaB_6$ cathode.

According to the method of the present invention, it is possible to form a $LaB_6$ cathode having a large adhesive strength, and easily effect activation treatment upon formation of the $LaB_6$ cathode. In this connection, it is possible to obtain a discharge display device which is less influenced by the glass binder and is improved in life characteristics, In other words, in the present invention, the $LaB_6$ layer containing no glass binder is formed on the temporarily dried conductive paste layer, and both the $LaB_6$ layer and the conductive paste layer are simultaneously burnt. As a result a part of the glass binder in the conductive paste layer is wetted and migrated into the $LaB_6$ layer. Accordingly, it is possible to form a satisfactory $LaB_6$ cathode having a large adhesive strength without using a $LaB_6$ paste containing a glass binder. Further, since the amount of glass binder to be contained in the $LaB_6$ is sufficiently small, the activation step may be easily carried out. Additionally, since the amount of the glass binder to be scattered upon activation becomes small, life of the discharge display device may be further improved.

As a result of experiment, it has been found that the life of the discharge display device is increasingly improved as the particle size of the $LaB_6$ powder becomes smaller, and that in case of the same particle size, the life as in the present invention is exended as compared with the case where a $LaB_6$ paste containing the glass binder is used.

DETAILED DESCRIPTION OF THE PREFERRED EMBODIMENT

Figure 1:
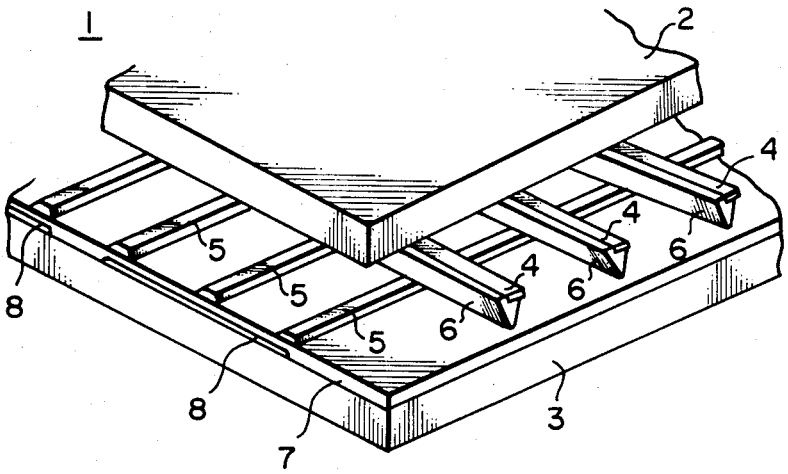
FIG. 1 is a perspective view of an exemplary discharge display device employable in accordance with the present invention.

First, an exemplary discharge display device employable in the present invention will now be described with reference to FIG. 1, in which the discharge display device is applied to a direct current type discharge display panel of a trigger discharge system. A discharge panel 1 comprises a front glass substrate 2, a rear glass substrate 3, anodes 4 and cathodes 5 of XY matrix shape. Each of the anodes 4 is partitioned from each other by insulating barriers 6. On the rear glass substrate 3, trigger electrodes 8, formed of aluminum (Al) for example, are arranged in parallel relation with the cathodes 5 through an insulated dielectric layer 7 under the cathodes 5.

The display panel 1 is manufactured in the following manner. First, the anodes 4 and the insulating barriers 6 are formed on the front glass substrate 2 by a thick-film printing method. Similarly, the trigger electrodes 8, the insulated dielectric layer 7 and the cathodes 5 are sequentially formed on the rear glass substrate 3 by the thick-film printing method. Each of these parts is burnt after printing. Then, both the glass substrates 2 and 3 are oppositely arranged with the anodes 4 and the cathodes 5 are crossed at a right angle, and are frit-sealed. Thereafter, heating exhaustion, gas sealing (e.g., Ne-Ar gas) and final sealing are carried out to complete the display panel 1.

In such a discharge display panel 1 as obtained above, a driving voltage is selectively applied to the anodes 4 and the cathodes 5 to generate discharge luminescence at cross-points between the selected anodes 4 and cathodes 5, thereby effecting display in a linearly sequential manner. Especially, in this display panel 1, a trigger voltage is applied to the trigger electrodes 8 prior to effecting of discharge between the anodes 4 and the cathodes 5 to induce a wall voltage on a portion of the insulated dielectric layer 7 corresponding to the trigger electrodes 8 and effect momentary discharge between the insulated dielectric layer 7 and the selected cathodes 5. As a result, a gas space along the cathodes 5 is ionized, so that subsequent discharge between the selected anodes 4 and cathodes 5 may be easily effected.

The present invention is directed to a method of forming the cathodes 5 in the discharge display panel by the thick-film printing method. A preferred embodiment of the present invention will be described below with reference to FIGS. 2A–2D.

In the preferred embodiment, a $LaB_6$ paste consisting of $LaB_6$ fine powder, and a suitable vehicle (solvent) only is preliminarily prepared without using a glass binder. Concretely, a $LaB_6$ sintered powder as roughly pulverized is further pulverized by a ball mill to prepare a $LaB_6$ fine powder. The $LaB_6$ fine powder is selected in such a manner that an average particle size thereof is to be not more than several $\mu$m, preferably 1–3 $\mu$m, and powder having an average particle size of not less than 5 $\mu$m is to be contained in a proportion of not more than 5% with respect to the total amount of $LaB_6$ powder. After preparing the $LaB_6$ fine powder, it is washed with pure water for purpose of removing impurities, and is then mixed with vehicle to prepare a $LaB_6$ paste.

Figure 2A:
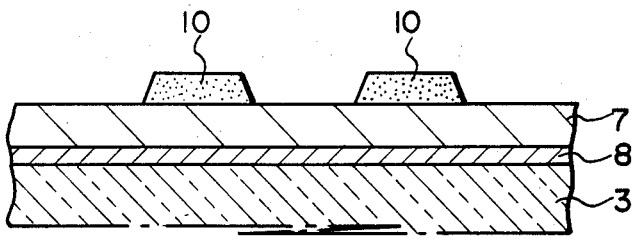
FIG. 2A to 2D are cross-sectional views exemplary of formation of $LaB_6$ cathode according to the present invention.

As shown in FIG. 2A, first the trigger electrode 8 and the insulated dielectric layer 7 are formed on the rear glass substrate 3, and then a conductive paste such as Ni paste containing a glass binder is applied and printed along a cathode pattern to be formed on the insulated dielectric layer 7 to form Ni paste layers 10. The Ni paste layers 10 subsequently serve as a base electrode for supplying current.

Figure 2B:
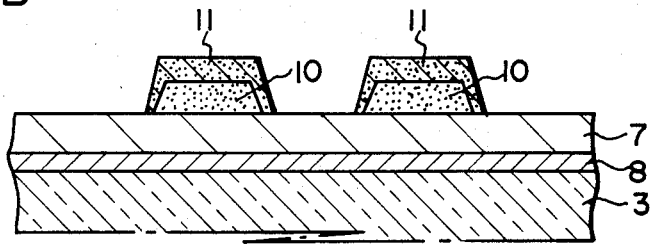
Figure 2C:
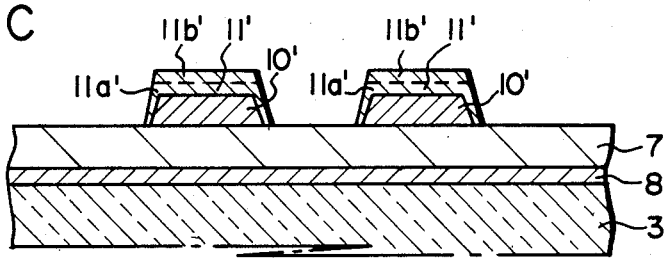

Next, as shown in FIG. 2B, the Ni paste layers 10 are dried, and then the $LaB_6$ paste is applied onto the Ni paste layers 10 to form $LaB_6$ layers 11.

Then, as shown in FIG. *2c*, the $LaB_6$ paste layers 11 are dried, and both the Ni paste layers 10 and the $LaB_6$ paste layers 11 are simultaneously burnt under such conditions as in the air at 500°–600° C., e.g., about 560°. In such a burning step as above Ni base layers 10' are formed. Further, during burning, a part of the glass binder contained in the Ni paste layers 10 is wetted and migrated into $LaB_6$ layers 11'. Owing to wetting of the glass binder, $LaB_6$ layers 11' a as wetted by the glass binder are increased in a bonding strength between the Ni base layers 10' and the $LaB_6$ layers 11' as well as between each of $LaB_6$ particles.

Figure 2D:
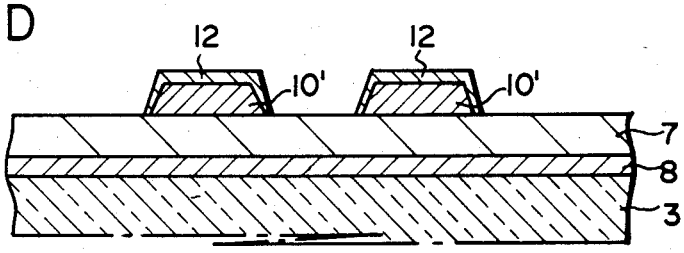

Then, as shown in FIG. 2D, surfaces **11'*b* of the $LaB_6$ layers 11' which are not wetted by the glass binder are removed. Thereafter, as is mentioned above, the front glass substrate 2 on which the anodes 4 formed of Ni for example and the barriers 6 are formed and the rear glass substrate are fritsealed, and heating exhaustion, sealing of desired gas and final sealing are carried out. Then, a predetermined voltage is applied between the anodes 4 and the Ni base electrodes 10' to effect activation treatment by gas discharge with a large current (cathode forming). With this activation treatment, no glass becomes present on a surface of the $LaB_6$ layers 11' a (so-called discharge surface), and $LaB_6$ itself is exposed to the discharge surface. Furthermore, there occurs sintering between each of the $LaB_6$ particles owing to a local thermal effect, thereby making the $LaB_6$ layers 11'*a* in a fused and bound condition. As a result, resistance in the $LaB_6$ layers is decreased. A current density during activation is 2–5$^A$/cm$^2$. Thusly, $LaB_6$ cathodes 12 are formed on the Ni base electrodes 10'**.

According to the method as described above, the $LaB_6$ paste layers 11 containing no glass binder are applied and printed onto the Ni paste base layers 10 as temporarily dried, and then both the layers 10 and 11 are simultaneously burnt, thereby permitting a part of the glass binder contained in the Ni paste layers 10 to be wetted into the $LaB_6$ layers 11'. Accordingly, owing to such wetting of the glass binder, it is possible to finally obtain $LaB_6$ cathodes 12 having a large adhesive strength. Further, as the amount of the glass binder to be contained in the $LaB_6$ layers 11' is small, the amount of the glass binder to be scattered upon activation by gas discharge with large current is also small, thereby reducing negative influence due to scatter of the glass binder, resulting in improvement to the life of the discharge display device.

In this manner, according to the preferred embodiment of the invention, a satisfactory $LaB_6$ cathode may be formed by the thick-film printing method.

Although the $LaB_6$ paste containing no glass binder is applied and printed onto the Ni paste base layer in the preferred embodiment, it is also possible to form a $LaB_6$ layer on the Ni paste layer by an electrodeposition method and the like in substitution for the $LaB_6$ paste.

Further, although the preferred embodiment as mentioned above is applied to the direct current type discharge display panel of trigger discharge system, it will be appreciated that the present invention is applicable to formation of the cathode for the other discharge display panels.

I claim as my invention:

1. A method of producing a discharge display device comprising the steps of applying to a dielectric substrate a conductive paste containing a glass binder, temporarily drying said conductive paste layer, forming a $LaB_6$ layer containing no glass binder on said conductive paste layer, burning said conductive paste layer and said $LaB_6$ layer at the same time, and activating said $LaB_6$ layer after being burnt by gas discharge with large current after an exhaustion step to form a $LaB_6$ cathode.

2. The method set forth in claim 1 wherein said $LaB_6$ layer is electrodeposited.

3. The method set forth in claim 1 wherein said $LaB_6$ layer is a paste layer deposited on said conductive paste by thick film printing.

* * * * *